United States Patent [19]

Gimeno et al.

[11] Patent Number: 4,953,299

[45] Date of Patent: Sep. 4, 1990

[54] PROCESS AND APPARATUS FOR FREEZE-DRYING COMPRISING MEANS FORMING AN ACTIVE THERMAL SHIELD BETWEEN THE FREEZE-DRYING SHELVES

[75] Inventors: René Gimeno, Pelussin; Alain Huc, Ste Foy Les Lyon; Pierre DeVictor, La Mulatiere, all of France

[73] Assignee: Societe Anonyme, Bioetica, Lyon, France

[21] Appl. No.: 272,483

[22] Filed: Nov. 16, 1988

[30] Foreign Application Priority Data

Nov. 17, 1987 [FR] France ..... 87 15880

[51] Int. Cl.[5] ..... F26B 5/06

[52] U.S. Cl. ..... 34/92; 34/5

[58] Field of Search ..... 34/5, 15, 92

[56] References Cited

U.S. PATENT DOCUMENTS

| | | | |
|---|---|---|---|
| 2,602,825 | 7/1952 | Flosdorf | 34/5 X |
| 3,118,742 | 1/1964 | Dalgleish | 34/92 |
| 3,135,589 | 6/1964 | Stokes | 34/73 |
| 4,501,719 | 2/1989 | Williams | 422/102 |

FOREIGN PATENT DOCUMENTS

| | | | |
|---|---|---|---|
| 2284842 | 9/1976 | France . | |
| 58-74103 | 5/1983 | Japan | 34/5 |

*Primary Examiner*—Henry A. Bennet
*Assistant Examiner*—John Sollecito
*Attorney, Agent, or Firm*—Weingarten, Schurgin, Gagnebin & Hayes

[57] ABSTRACT

This invention relates to a process and apparatus for freeze-drying, said apparatus comprising freeze-drying shelves disposed inside a freeze-drying enclosure, on which may be placed products or solutions to be freeze-dried, which may be contained in open recipients, as well as cooling and/or heating means associated with and preferably incorporated in said shelves, wherein means forming a thermal shield are disposed between said freeze-drying shelves, thus making it possible to slow down the heat exchanges between the surface of the product to be freeze-dried and the heating and/or cooling elements associated with the shelves. More homogeneous freeze-dried products are obtained in this way.

14 Claims, 3 Drawing Sheets

PROCESS AND APPARATUS FOR FREEZE-DRYING COMPRISING MEANS FORMING AN ACTIVE THERMAL SHIELD BETWEEN THE FREEZE-DRYING SHELVES

FIELD OF THE INVENTION

The present invention relates to a process and an apparatus for lyophilization or freeze-drying, comprising means forming an active thermal shield between the freeze-drying shelves.

BACKGROUND OF THE INVENTION

Lyophilization or freeze-drying is a drying technique employing freezing then sublimination of the water contained in the frozen product.

This process, although expensive, is being developed more and more, as it allows numerous substances to be dried without their properties altering. The principal applications are as follows:

preservation of fragile products of biological origin;

preservation and storage of food products, these products then being very easily dissolvable, freeze-drying giving these products a very aerated structure of which the surface of contact with the solvent is very large;

solution to the problem of packing if it is desired to introduce very small quantities of solid substances in flasks. In that case, the solution of the substance is introduced into the recipient and then freeze-dried, an adequate dilution allowing the solution to be very easily weighed;

solution to the problem of Galenicals by leading to the solidification of certain substances which will find a direct application in this presentation.

A cycle of freeze-drying comprises three steps:

freezing, operation during which the product to be dried is taken to a temperature of total solidification or eutectic temperature, sublimation, during which the water passes directly from the solid state to the state of vapour and will be trapped in the solid state on a cold wall. During this operation, the partial vapour pressure above the product must be lower than the vapour pressure of the ice at the same temperature, the temperature of the product remaining lower than the eutectic temperature, secondary drying. This phase is intended to eliminate the traces of water remaining in the product. To that end, it will be necessary to have the lowest possible partial pressure and the highest possible temperature of the product lower than that of its denaturation.

It follows from the foregoing that the shape of the product is set during the freezing process and that it will remain unchanged until the end of freeze-drying. Morever, it is absolutely indispensable that the temperature of the product remains lower than the eutectic temperature.

Freeze-drying may be carried out in two types of apparatus: the first consists of flasks in the atmosphere and connected to the enclosure in vacuo containing the trap. In this system, the substance is previously frozen in the flask placed to that end in a freezer. In this system, the calories necessary for sublimation are brought by the atmosphere. The second type of apparatus consists in shelves on which the product to be freeze-dried is placed. The product may be pre-frozen or frozen in situ on the shelves. When freezing is terminated, freeze-drying is carried out on the same shelves which will be heated so as to bring to the product the calories necessary for sublimation of the water.

This latter type of apparatus is at the present time the only one used on an industrial scale. In this case, freezing in situ may raise serious difficulties when the product is viscous and consequently heat exchanges are difficult. In that case, two phenomena may occur: on the one hand, during freezing, a hummock appears and, on the other hand, during freeze-drying, the formation on the surface of a film which is more compact than the rest of the product. This leads to a heterogeneous material being obtained, a defect rendering the product unusable when freeze-drying is used as means for shaping. These phenomena will occur all the more clearly as the thickness to be freeze-dried is greater.

The first phenomenon comes from the imprisonment of a certain quantity of liquid between an envelope of ice forming on the bottom, the walls of the plate containing the substance as well as on the surface of the product. The negative calories on the bottom and walls are brought by conduction from the freeze-drying shelf, whilst, on the surface of the product, they are brought essentially by radiation from the shelf above. When the imprisoned liquid begins to freeze, there is an increase in volume and the liquid passes through the frozen wall of the surface and forms a hummock which freezes (FIG. 1).

The second phenomenon, i.e. the formation of a film on the surface of the product is provoked by a defrosting due to a heating by radiation of the shelf of the freeze-drying apparatus located just above the freeze-drying plate, and to the absence of a sufficient heat conduction within the product. Such defrosting brings about liquefaction of the water of the product which is no longer sublimated but evaporates. This results in the formation of a more compact film on the surface of the product which renders the freeze-dried material heterogeneous.

Moreover, this film is relatively impermeable. It may in certain cases contribute to lengthening the freeze-drying time by slowing down the exchanges between the gas and the deeper layers of frozen product.

U.S. Pat. No. 4,501,719 relates to a freeze-drying apparatus comprising a plate laminate 14 provided with wells 12 in which the solutions 16 to be freeze-dried are disposed. Col. 2, lines 62 to 68 and col. 4, lines 50 to 58 mention the use of an insulator 43 disposed above the plate 14 containing the freeze-dried solutions disposed in the wells 12 (cf. FIG. 3). This insulator 43 is made of Styrofoam, with an intermediate plexiglass sheet 44. It is preferably enveloped in an aluminium foil to augment its insulation properties (cf. 4, lines 50 to 53).

According to this document, the use of a passive thermal shield is thus provided. However, in practice, it has appeared that such a passive thermal shield does not solve the technical problems set forth hereinabove and therefore presents the same drawbacks. In addition, the use of a passive thermal shield does not enable homogeneous and flat products to be obtained in the case of viscous solutions, particularly when they are in a considerably thick arrangement.

It is therefore an object of the present invention to solve the new technical problem of providing a solution for obtaining, by freeze-drying, freeze-dried products which are homogeneous or with greatly improved homogeneity, with respect to the products obtained by the heretofore known freeze-drying processes and apparatus.

It is another principal object of the present invention to solve the new technical problem of providing a process and an apparatus for freeze-drying various viscous products or solutions, which are very difficult to freeze-dry, enabling very homogeneous and flat products to be obtained.

It is another principal object of the present invention to solve the new technical problem of providing a process and apparatus for freeze-drying various products or solutions, particularly viscous solutions, even in a considerably thick arrangement, which results in homogeneous freeze-dried products.

It is yet another object of the invention to solve the new technical problem of providing a process and apparatus for freeze-drying various products or solutions, in particular viscous solutions which may be in a considerably thick arrangement, resulting in homogeneous products, which is of extremely simple design, with low manufacturing costs, and adapted to be used on an industrial scale.

All these new technical problems are solved for the first time by the present invention in simple manner and applicable on an industrial scale.

SUMMARY OF THE INVENTION

According to a first aspect, the present invention provides a process for lyophilizing or freeze-drying various products or solutions, particularly viscous solutions, which may be in a considerably thick arrangement, comprising the positioning of products or solutions to be freeze-dried, which may be contained in open recipients, on freeze-drying shelves disposed inside a freeze-drying enclosure, said shelves comprising cooling means and heating means associated therewith and preferably incorporated therein, said process comprising firstly a step of freezing products or solutions to be freeze-dried, then a step of freeze-drying proper with sublimation of the water contained in the frozen product, characterized in that there are provided between said freeze-drying shelves, means forming active thermal shield comprising heating and/or cooling means for slowing down the heat exchanges between the surface of the product and said cooling or heating means associated with the shelves, thus obtaining substantially homogeneous freeze-dried products.

According to a particular variant embodiment, the heating means of the means forming an active shield are actuated during the freezing step.

According to another particular variant embodiment, the cooling means of said means forming an active shield are actuated during freeze-drying proper.

According to yet another particular variant embodiment, the heating and/or cooling means of the means forming an active shield take the form of heating resistors.

According to a further particular embodiment, these heating and/or cooling means are constituted by the production of the means forming a shield in the form of hollow plates in which a heat-exchanging fluid is circulated.

According to a second aspect, the present invention also concerns an apparatus for freeze-drying various products or solutions, particularly viscous solutions which may be in a considerably thick arrangement, comprising freeze-drying shelves disposed inside a freeze-drying enclosure, on which may be placed products or solutions to be freeze-dried, which may be contained in open recipients, as well as cooling and/or heating means associated with and preferably incorporated in said shelves, characterized in that means forming an active thermal shield are disposed between said freeze-drying shelves, comprising heating and/or cooling means, thus making it possible to slow down the heat exchanges between the surface of the product to be freeze-dried and the heating and/or cooling elements associated with the shelves.

According to a particular variant embodiment, these means forming an active shield may be made in the form of plates, advantageously in a shape matching the freeze-drying shelves, and may be fixed beneath said shelves, i.e. opposite the products to be freeze-dried resting on said shelf.

According to a particular embodiment, these plates constituting the means forming an active screen contain heating resistors.

According to another particular embodiment, these plates contain, embedded in the mass, elements capable of heating during freezing and of cooling during freeze-drying proper (step of sublimation of the water).

According to yet another embodiment of the apparatus of the invention, the plates constituting the means forming an active shield are hollow and are provided to allow circulation of a heat-exchanging fluid inside said plates.

According to a still further embodiment of the apparatus according to the invention, it is characterized in that the calories or the heat-exchanging fluid circulating inside the plates forming shield, come from the system of heating and cooling the freeze-drying trays, the calories used being those supplied by the refrigerating unit during cooling of the freezing operation, whilst, during the period of freeze-drying, on the contrary, the negative calories are sent into the plates forming an active shield and the calories into the freeze-drying trays.

According to another variant embodiment of the freeze-drying apparatus of the invention, it is characterized in that the calories of the heat-exchanging fluid circulating inside the plates forming an active shield come from an independent heating system, inside or outside the freeze-drying apparatus.

Thanks to the process and apparatus according to the invention, freeze-dried products are obtained, having homogeneous characteristics, as demonstrated in an Example given hereinbelow by way of illustration.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
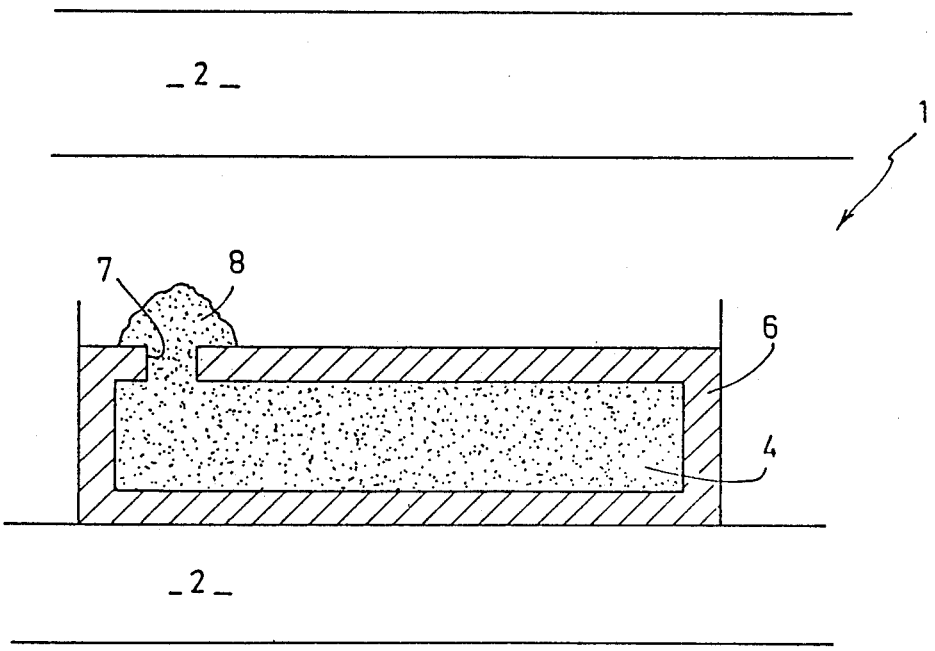
FIG. 1 is a view in partial section of the freeze-drying apparatus according to the invention showing two successive shelves of the freeze-drying apparatus, according to the prior art.

Referring now to the drawings, FIG. 1 shows a freeze-drying apparatus, generally referenced 1, which conventionally comprises shelves 2 on which are disposed various products or solutions 4 to be freeze-dried, possibly contained in open recipients 6.

These shelves 2 are conventionally equipped with heating and cooling means, for effecting the step of freezing, then the step of sublimation of the water contained in the frozen product.

In practice, the shelves 2 are hollow and a heat-exchanging medium taken either to the temperature necessary for freezing the products, or to the temperature necessary for sublimation of the water, is circulated in said hollow shelves.

With such a freeze-drying apparatus according to the prior art, when the liquid imprisoned in product 4 begins to freeze, liquid passes through the frozen wall of the surface, forming a hummock 8 above the opening 7 of the recipient 6 in which product 4 is obtained, which freezes above this opening 7, as is clearly visible in FIG. 1.

Similarly, a film is formed on the surface of the product provoked by a defrosting due to a heating by radiation of the shelf of the freeze-drying apparatus located just above the freeze-drying tray on which the product rests, and to the absence of a sufficient heat conduction within the product.

Such defrosting causes liquefaction of the product which is no longer sublimated but evaporates.

A more compact film is then formed on the surface of the product which renders the freeze-dried product heterogeneous.

Figure 2:
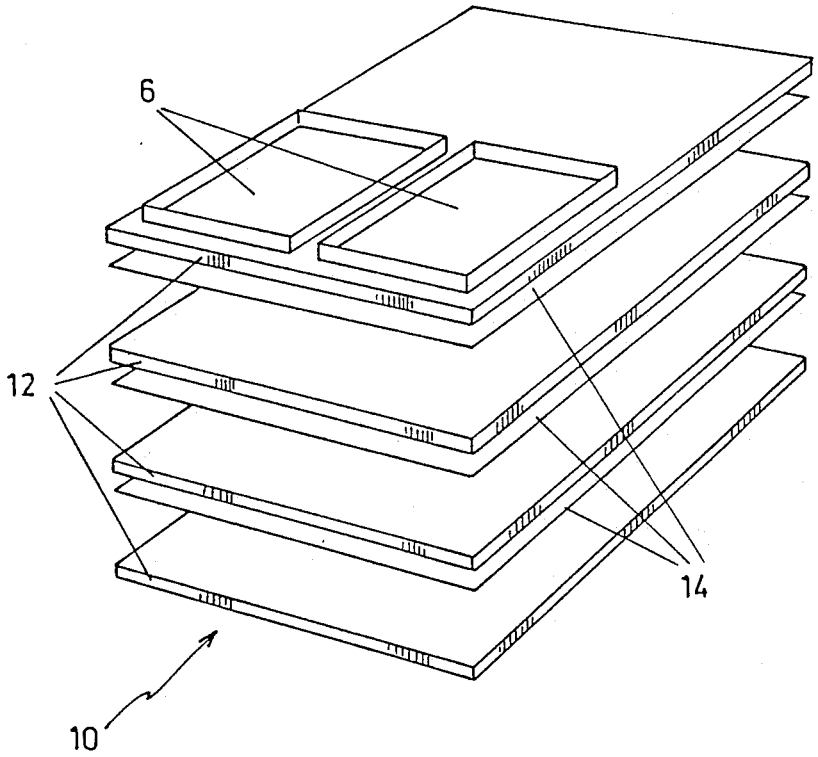
FIG. 2 shows, in perspective, in partial section, several shelves of the freeze-drying apparatus equipped with means forming a shield, according to the invention.

This major defect of the prior known freeze-drying apparatus is overcome by the freeze-drying apparatus according to the invention, shown in FIG. 2.

FIG. 2 shows a freeze-drying apparatus according to the invention, referenced 10, which likewise comprises freeze-drying shelves 12, which may be identical to those of the freeze-drying apparatus shown in FIG. 1, as described hereinabove.

However, according to the invention, this freeze-drying apparatus 10 comprises means forming an active thermal shield 14, disposed between the shelves 12, as may readily be seen in FIG. 2.

In practice, it is easier to fix these means forming an active shield 14 beneath the shelves 12.

These means forming an active shield 14 may be shaped to the dimensions of the shelves 12.

According to a particular variant embodiment, these means forming an active shield may thus take the shape of plates.

According to first embodiment, the plates constituting the means forming an active shield comprise heating means and/or cooling means.

Figure 3:
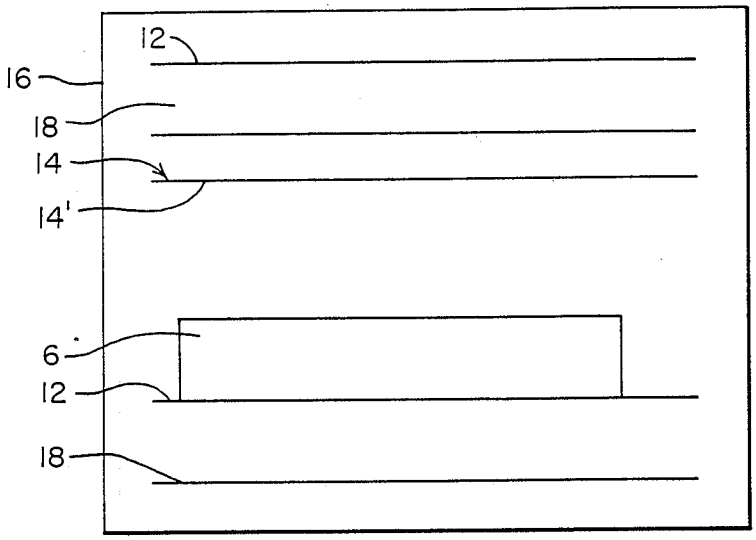
FIG. 3 is a view in section of an embodiment of the present invention.

These heating means may be formed by simple heating resistors 14, as shown in FIG. 3.

Figure 4:
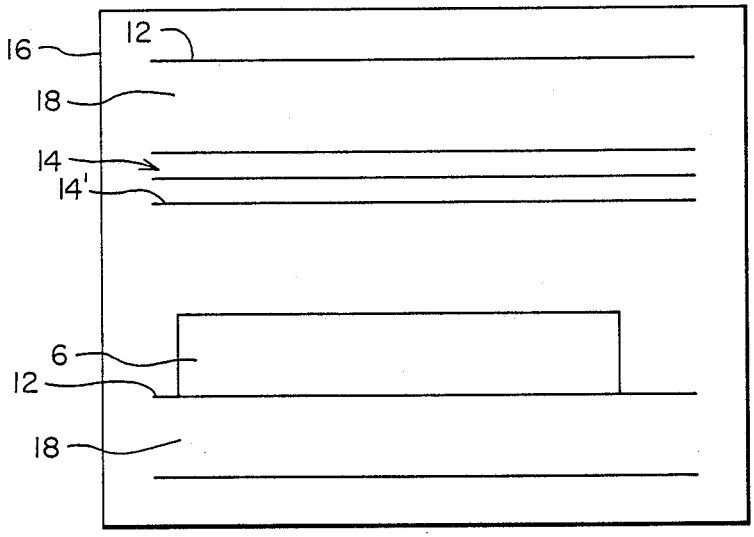
FIG. 4 is a view in section of a further embodiment of the present invention.

The heating and/or cooling means of the means forming a shield 14 may be constituted by a heat-exchanging fluid circulating in the plates which are, in that case, made to be hollow, as shown at 14' in FIG. 4.

This apparatus operates in accordance with the process described hereinabove; a heating is thus effected inside the means forming shield during freezing. This makes it possible advantageously to slow down heat exchange between the surface of the product and the cooling elements of the freeze-drying apparatus, contained in the shelves, during the freezing step.

According to an advantageous embodiment, the means forming an active shield effect a cooling during the freeze-drying step proper, which is monitored so that the temperature of the frozen product rises gradually.

FIGS. 3 and 4 also illustrate the freeze-drying shelves 12 disposed inside a freeze-drying enclosure 16. The shelves 12 may be equipped with heating and cooling means 18, for example, hollow regions within shelves 12 through which a heat-exchanging fluid circulates.

A practical example of the invention carrying out the process according to the invention will be given hereinafter.

EXAMPLE

Preparation of a pad of collagen for haemostatic purposes in surgery.

Collagen gel containing 0.7% of protein is poured into the trays, the thickness of gel being 12 mm. Freezing is effected at −60° C. for 3 hours. During this period of time, the heating means of the means forming an active shield 14, constituted by heating resistors, with a power of 225 W/m$^2$, are supplied with a voltage of 220 V. At the end of this phase, the electrical supply is stopped and freeze-drying is set into action. To that end, a vacuum of 0.3 mb is created in the freeze-drying enclosure and the shelves are heated so that the temperature of the frozen product is maintained at −25° C. This latter phase lasts about 16 hours. Secondary drying then takes place, during which the vacuum is lowered to $10^{-2}$mb and the temperature of the product taken to 40° C. This operation takes approximately 3 hours.

In order to determine the relative homogeneity of the material obtained, two layers 2 mm thick are slit with the aid of a rotating saw: one layer from the side of the biomaterial facing the shelf above during freeze-drying, and the other from the side in contact with the tray placed on the cooling and heating shelf. These two layers were weighed for five different freeze-dryings.

| freeze-drying (invention) | I | II | III | IV | V | average |
|---|---|---|---|---|---|---|
| weight upper layer, mg | 99.5 | 84.8 | 106.3 | 96.7 | 108.8 | |
| weight lower layer, mg | 99.1 | 76.1 | 104.1 | 97.5 | 106.8 | |
| % of difference with respect to the weight of the upper layer | 0.4 | 10.3 | 2.07 | −0.8 | 1.8 | 2.7 |

These results are to be compared with those obtained by the same freeze-drying apparatus not equipped with the active shield means according to

| freeze-drying (comparative) | 1 | 2 | 3 | 4 | 5 | average |
|---|---|---|---|---|---|---|
| weight upper layer, mg | 88.8 | 81.9 | 85.7 | 92.9 | 84.1 | |
| weight lower layer, mg | 61.5 | 61.0 | 65.7 | 70.3 | 58.0 | |
| % of difference with respect to the weight of the upper layer | 31.0 | 26.5 | 23.3 | 24.3 | 31.0 | 27.2 |

The first results are also to be compared with those obtained by the same freeze-drying apparatus equipped with passive shield means constituted solely by an insulating material.

The results shown in the following table were obtained with passive shields constituted by formophenolic foam with closed pores, 2 cm thick, maximum distance available between the freeze-drying trays.

| freeze-drying (comparative) | a | b | c | d | e | average |
|---|---|---|---|---|---|---|
| weight upper layer, mg | 92.5 | 93.3 | 90.0 | 89.8 | 94.1 | |
| weight lower layer, mg | 69.5 | 68.3 | 69.1 | 66.2 | 67.2 | |
| % of difference with respect to the weight of the upper layer | 24.8 | 26.7 | 23.2 | 26.2 | 26.9 | 25.6 |

The above three Tables immediately show that the relative weight difference of the two outer layers of the freeze-dried product is much less in the case of using the shield means (14) of the invention than in the case of conventional freeze-drying or a freeze-drying with passive shield means.

The invention is particularly advantageous, on the one hand, in the case of freeze-drying viscous solutions within which heat exchanges by convection are very difficult and, on the other hand, in the case of freeze-drying large thicknesses which prevent rapid heat exchanges between the face of the product in contact with the shelf of the freeze-drying apparatus and the surface.

When the shield is formed by plates containing heating resistors, or in which a heat-exchanging fluid passes, the material constituting the plates is a heat-conducting material, advantageously a metal, for example anodized aluminium or a stainless steel.

According to a variant embodiment of the freeze-drying apparatus of the invention, said apparatus is characterized in that the calories or the heat-exchanging fluid circulating inside the plates forming active shield come from the system for heating and cooling the freeze-drying trays, the calories used being those supplied by a refrigerating unit during the cooling of the freezing operation, whilst, during the period of freeze-drying, on the contrary, the negative calories are sent into the plates forming an active shield and the calories into the freeze-drying trays.

According to another variant embodiment of the freeze-drying apparatus of the invention, it is characterized in that the calories of the heat-exchanging fluid circulating inside the plates forming an active shield come from an independent heating system, inside or outside the freeze-drying apparatus.

What is claimed is:

1. An apparatus for freeze-drying viscous solutions which may be in a comprising:
   - a freeze-drying enclosure;
   - freeze-drying shelves disposed inside the freeze-drying enclosure to support the products or solutions to be freeze-dried;
   - first means for adjusting the temperature associated with each of the freeze-drying shelves; and
   - means forming an active thermal shield disposed between the freeze-drying shelves, the shield means including second means for adjusting the temperature to slow down heat exchanges between the product or solution to be freeze-dried and the temperature adjusting means associated with the shelves.

2. The freeze-drying apparatus of claim 1, wherein the second temperature adjusting means of the shield means comprises means for heating and means for cooling.

3. The freeze-drying apparatus of claim 2, wherein the heating means of the shield means are actuated during freezing and the cooling means of the shield means are actuated during freeze-drying proper.

4. The freeze-drying apparatus of claim 1, wherein the shield means are in the form of plates in a shape matching the freeze-drying shelves, and are fixed beneath said shelves.

5. The freeze-drying apparatus of claim 4, wherein the plates constituting the shield means contain heating resistors.

6. The freeze-drying apparatus of claim 4, wherein the plates constituting the shield means are hollow to allow circulation of a heat-exchanging fluid inside said plates.

7. The freeze-drying apparatus of claim 6, wherein the calories of the heat-exchanging fluid circulating inside the plates forming the shield means come from the first temperature adjusting means associated with the freeze-drying shelves, the calorie used being those supplied during cooling for freezing, while, during freeze-drying, negative calories are sent into the plates forming the shield means and the calories into the freeze-drying shelves.

8. The freeze-drying apparatus of claim 7, wherein the independent heating system is disposed inside the freeze-drying enclosure.

9. The freeze-drying apparatus of claim 7, wherein the independent heating system is disposed outside the freeze-drying enclosure.

10. The freeze-drying apparatus of claim 6, wherein the calories of the heat-exchanging fluid circulating inside the plates forming the shield means come from an independent heating system.

11. The freeze-drying apparatus of claim 10, wherein the first temperature adjusting means includes means for heating.

12. The freeze-drying apparatus of claim 10, wherein the first temperature adjusting means includes means for cooling.

13. The freeze-drying apparatus of claim 1, wherein the first temperature adjusting means is incorporated within the freeze-drying shelves.

14. An apparatus for freeze-drying products comprising:
   - a freeze-drying enclosure;
   - freeze-drying shelves disposed inside the freeze-drying enclosure to support the products to be freeze-dried;
   - means for adjusting the temperature associated with each of the freeze-drying shelves;
   - means forming an active thermal shield disposed between the freeze-drying shelves, the shield means including means for heating and cooling to slow down heat exchanges between the product to be freeze-dried and the temperature adjusting means associated with the shelves; and
   - means for actuating the heating means during freezing of the products and means for actuating the cooling means during freeze-drying proper of the products.

* * * * *

UNITED STATES PATENT AND TRADEMARK OFFICE

CERTIFICATE OF CORRECTION

PATENT NO. : 4,953,299

DATED : September 4, 1990

INVENTOR(S) : Rene Gimeno, et al.

It is certified that error appears in the above-identified patent and that said Letters Patent is hereby corrected as shown below:

Column 5, line 55, "According to first embodiment," should read --According to a first embodiment,--.

Column 5, line 59, "resistors 14," should read --resistors 14',--

Column 6, line 57, "according to" should read --according to the invention:--.

Column 8, line 26, "calorie" should read --calories--.

Signed and Sealed this

Fourth Day of August, 1992

*Attest:*

DOUGLAS B. COMER

*Attesting Officer*

*Acting Commissioner of Patents and Trademarks*